US008971498B2

(12) United States Patent
Haider

(10) Patent No.: US 8,971,498 B2
(45) Date of Patent: Mar. 3, 2015

(54) CONTOUR COLLIMATOR AND ADAPTIVE FILTER HAVING A MAGNETIC FLUID ABSORBING X-RAY RADIATION AND ASSOCIATED METHOD

(71) Applicant: Sultan Haider, Erlangen (DE)

(72) Inventor: Sultan Haider, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 203 days.

(21) Appl. No.: 13/761,988

(22) Filed: Feb. 7, 2013

(65) Prior Publication Data

US 2013/0202092 A1 Aug. 8, 2013

(30) Foreign Application Priority Data

Feb. 8, 2012 (DE) ..... 10 2012 201 855

(51) Int. Cl.
*G21K 1/02* (2006.01)
*G21K 1/04* (2006.01)
*G21K 1/10* (2006.01)

(52) U.S. Cl.
CPC ... *G21K 1/04* (2013.01); *G21K 1/10* (2013.01)
USPC ..... 378/147; 378/150

(58) Field of Classification Search
CPC ..... G21K 1/10; G21K 1/02; G21K 1/025; G21K 1/046
USPC ..... 378/145–151, 156–159
See application file for complete search history.

(56) References Cited

U.S. PATENT DOCUMENTS

| | | | |
|---|---|---|---|
| 3,755,672 | A | 8/1973 | Edholm et al. |
| 4,794,629 | A | 12/1988 | Pastyr |
| 5,037,374 | A | 8/1991 | Carol |
| 5,438,991 | A | 8/1995 | Yu et al. |
| 5,442,675 | A | 8/1995 | Swerdloff et al. |
| 5,559,853 | A | 9/1996 | Linders et al. |
| 5,625,665 | A | 4/1997 | Fokkink et al. |
| 5,677,943 | A | 10/1997 | Hoebel |
| 5,745,279 | A | 4/1998 | Ciscato et al. |
| 5,751,786 | A | 5/1998 | Welters et al. |
| 5,768,340 | A | 6/1998 | Geittner et al. |
| 5,878,111 | A | 3/1999 | Schulz |
| 5,889,834 | A | 3/1999 | Vilsmeier et al. |
| 6,052,436 | A | 4/2000 | Huttner et al. |
| 6,118,855 | A | 9/2000 | Welters et al. |
| 6,269,147 | B1 | 7/2001 | Powell |

(Continued)

FOREIGN PATENT DOCUMENTS

| | | | |
|---|---|---|---|
| DE | 4422780 | A1 | 1/1996 |
| DE | 19638621 | C1 | 2/1998 |
| DE | 102006039793 | B3 | 1/2008 |

OTHER PUBLICATIONS

German Office Action dated Sep. 26, 2012 for corresponding German Patent Application No. DE 10 2012 201 855.7 with English translation.

(Continued)

*Primary Examiner* — Courtney Thomas
(74) *Attorney, Agent, or Firm* — Lempia Summerfield Katz LLC

(57) ABSTRACT

A contour collimator or an adaptive filter for adjusting a contour of a ray path of x-ray radiation is provided. The apparatus includes a magnetic fluid that is impermeable to x-ray radiation and a number of switchable magnet elements, by which an aperture forming the contour may be formed in the magnetic fluid.

20 Claims, 2 Drawing Sheets

(56) References Cited

U.S. PATENT DOCUMENTS

| | | | |
|---|---|---|---|
| 6,453,013 | B2 | 9/2002 | Prins |
| 6,757,355 | B1 | 6/2004 | Siochi |
| 6,813,336 | B1 | 11/2004 | Siochi |
| 6,920,203 | B2 | 7/2005 | Short et al. |
| 7,015,490 | B2 | 3/2006 | Wang et al. |
| 7,180,980 | B2 | 2/2007 | Nguyen |
| 7,224,763 | B2 | 5/2007 | Naidu et al. |
| 7,254,216 | B2 | 8/2007 | Thandiackal et al. |
| 7,272,208 | B2 | 9/2007 | Yatsenko et al. |
| 7,308,073 | B2 | 12/2007 | Tkaczyk et al. |
| 7,386,099 | B1 | 6/2008 | Kasper et al. |
| 7,894,574 | B1 | 2/2011 | Nord et al. |
| 7,993,058 | B2 | 8/2011 | Bohn et al. |
| 2003/0202632 | A1 | 10/2003 | Svatos et al. |
| 2004/0105525 | A1 | 6/2004 | Short et al. |
| 2005/0058245 | A1 | 3/2005 | Ein-Gal |
| 2009/0041199 | A1 | 2/2009 | Bohn |

OTHER PUBLICATIONS

German Office Action dated Jan. 11, 2013 for corresponding German Patent Application No. DE 10 2012 220 750.3 with English translation.

CONTOUR COLLIMATOR AND ADAPTIVE FILTER HAVING A MAGNETIC FLUID ABSORBING X-RAY RADIATION AND ASSOCIATED METHOD

This application claims the benefit of DE 10 2012 201 855.7, filed Feb. 8, 2012, which is hereby incorporated by reference.

BACKGROUND

The present embodiments relate to a contour collimator or an adaptive filter and to an associated method for adjusting a contour in a ray path in x-ray radiation.

A contour collimator is used in radiation therapy for the treatment of tumors. In radiation therapy, a tumor is irradiated with energy-rich radiation (e.g., with high-energy x-ray radiation of a linear accelerator). In such treatment, the contour collimator is brought into the ray path of the x-ray radiation. The contour collimator has an opening, through which radiation may pass. The contour of the opening is intended to correspond to the contour of the tumor. The contour thus forms an aperture for the passage of the x-ray radiation. This provides that the tumor, and not the adjoining healthy body tissue, is irradiated with the x-ray radiation. By embodying the contour collimator in a suitable manner, almost any given contour of a tumor may be mapped.

Collimators widely used for radiation therapy are multi-leaf collimators, as described, for example, in patent DE 10 2006 039793 B3. The multi-leaf collimator has a number of leaves (e.g., 160 leaves) able to be moved by motors in relation to one another to form the opening. The leaves include a material absorbing the x-ray radiation. Two packages of leaves are disposed opposite one another so that the leaves may be moved with end face sides towards one another or away from one another.

Each of the leaves is able to be displaced individually by an electric motor. Since there may be slight deviations in the positioning of the leaves between a required specification and the actual position of the leaves currently set, each leaf has a position measurement device, with which the position currently set may be determined.

In examinations with the aid of x-rays, it often occurs that the patient or organs of the patient exhibit a greatly differing absorption behavior with respect to the applied x-ray radiation in the area under examination. For example, in images of the thorax, the attenuation in the area in front of the lungs is very large, as a result of the organs disposed there, while in the area of the lungs, the attenuation is small. Both to obtain an informative image and also to protect the patient, the applied dose may be adjusted as a function of the area so that more x-ray radiation than necessary is not supplied. This provides that a larger dose is to be applied in the areas with high attenuation than in the areas with low attenuation. In addition, there are applications in which only a part of the area under examination is to be imaged with high diagnostic quality (e.g., with little noise). The surrounding parts are of importance for orientation but not for the actual diagnosis. These surrounding areas may thus be mapped with a lower dose in order to reduce the overall applied dose.

Filters are used to attenuate the x-ray radiation. Such a filter is known, for example, from DE 44 22 780 A1. This has a housing with a controllable electrode matrix, by which an electrical field that acts on a fluid connected to the electrode matrix, in which x-ray radiation-absorbing ions are present, is able to be generated. The x-ray radiation-absorbing ions are freely movable and move around according to the field applied. In this way, by forming an appropriate field, many or few irons may be correspondingly accumulated in the area of one or more electrodes in order to change the absorption behavior of the filter locally.

SUMMARY AND DESCRIPTION

The present embodiments may obviate one or more of the drawbacks or limitations in the related art. For example, a further contour collimator and a further adaptive filter that may map a contour robustly and rapidly are provided. In a further example, an appropriate method for forming a contour is provided.

An aperture forming the contour is generated with the aid of a magnetic fluid absorbing x-ray radiation or with a fluid impermeable to x-ray radiation (e.g., a ferrofluid). In a magnetic field, magnetic moments of the particles of the ferrofluid tend to travel in a direction and achieve macroscopic magnetization. Magnet elements generating magnetic fields are used to magnetize the fluid or parts of the fluid.

Ferrofluids are magnetic fluids that react to magnetic fields without solidifying. The ferrofluids are attracted by magnetic fields. The ferrofluids includes magnetic particles a few nanometers in size that are suspended in a colloidal manner in a carrier fluid. The particles may be stabilized with a polymer surface coating. True ferrofluids are stable dispersions, which provides that the solid particles do not break off over time and do not themselves accumulate on one another in extremely strong magnetic fields or separate from the fluid as another phase. Ferrofluids are supermagnetic and have a very low hysteresis.

A contour collimator or an adaptive filter for adjusting a contour of a ray path of x-ray radiation is provided. The apparatus includes a magnetic fluid impermeable to x-ray radiation and switchable magnet elements, by which an aperture forming the contour may be formed in the magnetic fluid by the magnetic fluid being attracted by the magnetic fields of the magnet elements. The contour forms the aperture (i.e., an opening in the contour collimator or the filter). An aperture may be a free opening or the diameter of the free opening, through which x-rays may be emitted or received. The embodiment offers the advantage of a robust collimator or filter, with which rapidly changing contours may be adjusted precisely In a further embodiment, the magnetic fluid may be a ferrofluid.

In one development, the magnetic fluid may be arranged in the form of a layer with limited expansion.

Furthermore, the apparatus may include at least one second layer, in which the magnet elements are arranged. The second layer may be arranged above or below the first layer. Alternatively, a second layer may be arranged above or below the first layer in each instance.

In a further embodiment, an electric grid structure formed from conductor paths is embodied in the second layer. The magnet elements are arranged at the points of intersection of the conductor paths.

In a development, the magnet elements may include coils, through which current passes.

The contour collimator or the filter may include an electric control unit, with the aid of which the magnet elements may be switched on and off according to the contour to be formed.

A number of first and second layers may also be stacked in order to form the contour collimator.

In one embodiment, a method for adjusting a contour of a ray path of x-ray radiation using a contour collimator or an adaptive filter is provided. Magnetic fields form an aperture forming the contour in a magnetic fluid that is impermeable to x-ray radiation, by the magnetic fields attracting the magnetic fluid.

In one embodiment, the magnetic fields may be formed by switchable magnet elements.

The magnetic fields may be formed by electric currents.

DETAILED DESCRIPTION OF THE DRAWINGS

Figure 1:
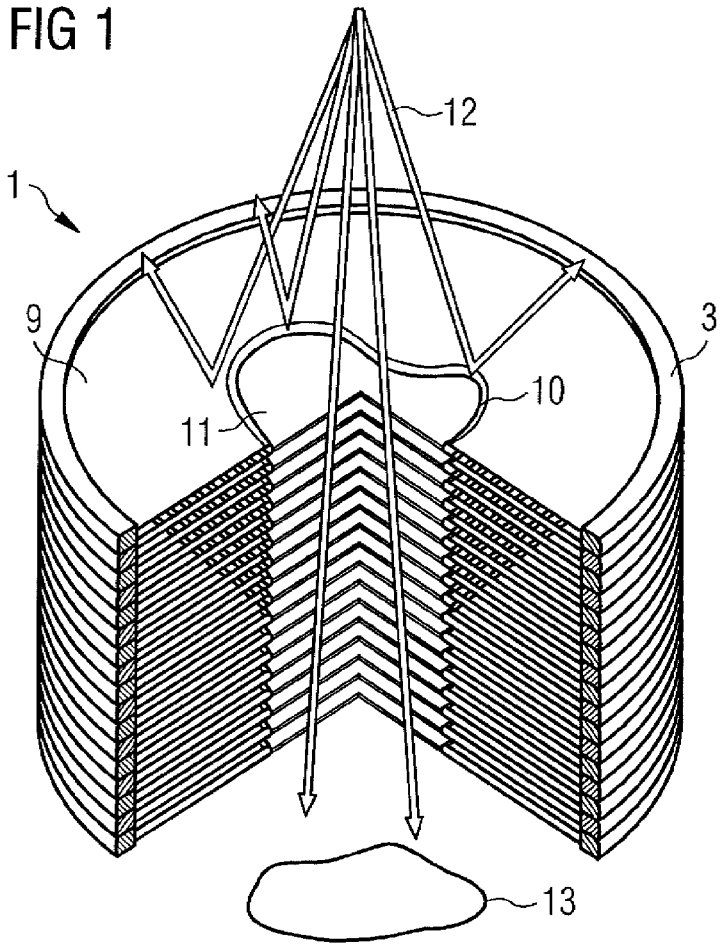
FIG. 1 shows a spatial view of one embodiment of a contour collimator.

FIG. 1 shows a spatial representation of one embodiment of a contour collimator 1 having a number of stacked contour plates 3. An aperture 11 forming a contour 10 is embodied in the collimator plates 3. The aperture 11 allows x-ray radiation 12 to pass through to an object 13 (e.g., a tumor). Except for the aperture 11, the collimator plates 3 are impermeable to x-ray radiation 12. The layers absorbing x-ray radiation 13 are formed by a magnetic fluid 9. Where the magnetic fluid 9 is absent, the aperture 11 is formed.

Figure 2:
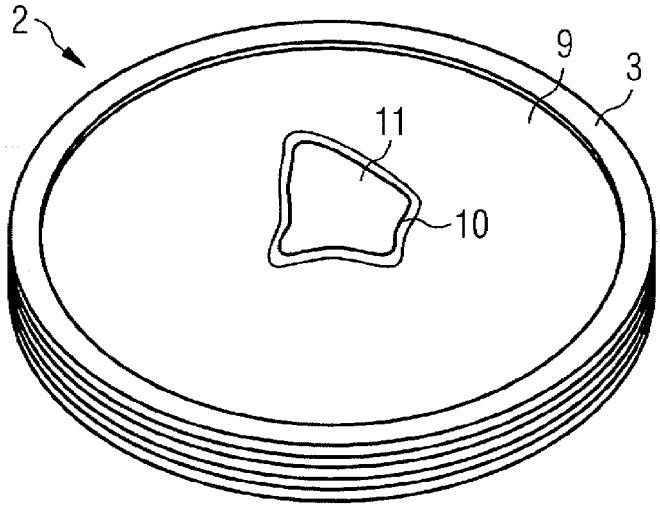
FIG. 2 shows a spatial view of one embodiment of an adaptive filter.

FIG. 2 shows a spatial representation of one embodiment of an adaptive filter 2 having three stacked filter plates 3. An aperture 11 forming the contour 11 is embodied in the filter plates 3. The aperture 11 allows x-ray radiation 12 to pass through. Except for the aperture 11, the filter plates 3 are impermeable to x-ray radiation 12. The layers absorbing x-ray radiation 12 are formed by a magnetic fluid 9. Where the magnetic fluid 9 is absent, the aperture 11 is formed.

Figure 3:
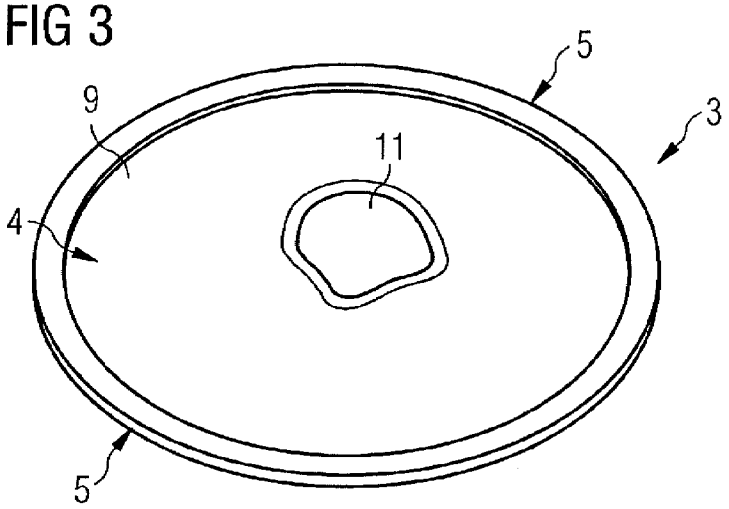
FIG. 3 shows a spatial view of one embodiment of a plate forming the contour collimator or the filter.

FIG. 3 shows a spatial view of one embodiment of a collimator plate and/or a filter plate 3. The plate 3 includes a first layer 4 that is formed by a magnetic fluid 9 that is impermeable to x-ray radiation. Magnetic fields may be generated by magnet elements (not shown in FIG. 3) arranged in second layers 5 using a second layer 5 including material transparent for x-ray radiation arranged thereabove and below. At the location of the aperture 11, the magnetic fluid 9 is "drawn in" (e.g., attracted) through the magnetic fields lying outside of the aperture, and x-ray radiation may pass therethrough unhindered.

Figure 4:
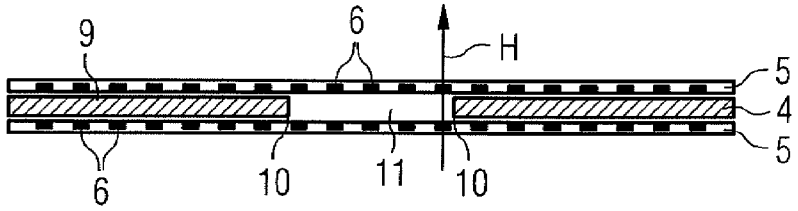
FIG. 4 shows a sectional view of one embodiment of a plate forming the contour collimator or the filter.

FIG. 4 shows one embodiment of the plate 3 from FIG. 3 in a sectional view. The two second layers 5 including the material that is transparent to x-ray radiation are visible. A plurality of magnet elements 6 (e.g., coils) is embodied in the second layers 5. The more magnet elements 6 there are available, the more precisely a contour 10 and/or the aperture 11 forming the same may be mapped. The first layer 4 with the magnetic fluid 9 that is not transparent for x-ray radiation is located between the two second layers 5 and is, for example, a ferrofluid. At the locations, at which the magnet elements 6 are active (e.g., generate a magnetic field H), the magnetic fluid 9 is attracted (e.g., removed from the area of the aperture 11 to be formed). As a result, the aperture 11 is produced.

Figure 5:
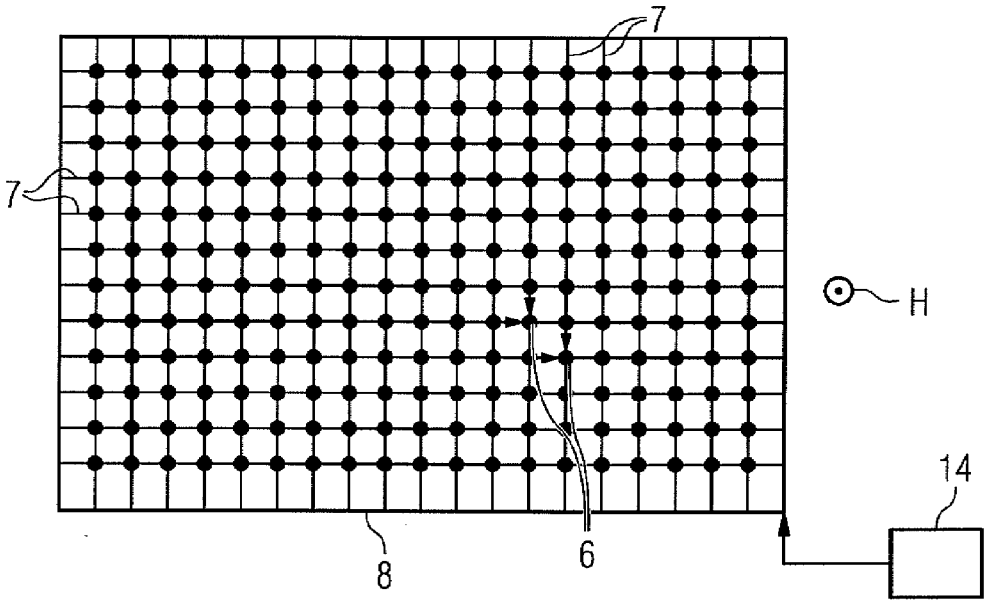
FIG. 5 shows a view of one embodiment of the grid structure in the second layer.

FIG. 5 shows a schematic representation of one embodiment of a grid structure 9 embodied in the second layer. The grid structure 8 is formed by conductor paths 7. Magnet elements 6 are disposed at points of intersection of the conductor paths 7 (e.g., two coils connecting conductor paths). The magnet elements 6 generate a magnetic field H at right angles to the second layer when current is flowing through the conductor paths. A control unit 14 is able to switch each magnet element 6 on and/or off at each point of intersection. The more points of intersection there are available, the more precisely the contour may be mapped.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A contour collimator or adaptive filter for adjusting a contour of a ray path of x-ray radiation, the contour collimator comprising:

a magnetic fluid that is impermeable to x-ray radiation; and switchable magnet elements, by which an aperture forming the contour is formable in the magnetic fluid by the magnetic fluid being attracted by magnetic fields of the switchable magnet elements.

2. The contour collimator or adaptive filter as claimed in claim 1, wherein the magnetic fluid is a ferrofluid.

3. The contour collimator or adaptive filter as claimed in claim 1, further comprising a first layer having the magnetic fluid.

4. The contour collimator or adaptive filter as claimed in claim 3, further comprising at least one second layer, in which the switchable magnet elements are arranged.

5. The contour collimator or adaptive filter as claimed in claim 4, further comprising an electrical grid structure formed from conductor paths in the at least one second layer, at points of intersection, of which the switchable magnet elements are arranged.

6. The contour collimator or adaptive filter as claimed in claim 1, wherein the switchable magnet elements include coils, through which current passes.

7. The contour collimator or adaptive filter as claimed in claim 1, further comprising an electric control unit operable to switch the magnet elements on and off in accordance with the contour to be formed.

8. The contour collimator as claimed in claim 4, wherein a plurality of first and second layers are stacked, the plurality of first and second layers comprising the first layer and the at least one second layer.

9. The contour collimator or adaptive filter as claimed in claim 2, further comprising a first layer having the magnetic fluid.

10. The contour collimator or adaptive filter as claimed in claim 9, further comprising at least one second layer, in which the switchable magnet elements are arranged.

11. The contour collimator or adaptive filter as claimed in claim 10, further comprising an electrical grid structure formed from conductor paths in the at least one second layer, at points of intersection, of which the switchable magnet elements are arranged.

12. The contour collimator or adaptive filter as claimed in claim 2, wherein the switchable magnet elements include coils, through which current passes.

13. The contour collimator or adaptive filter as claimed in claim 5, wherein the switchable magnet elements include coils, through which current passes.

14. The contour collimator or adaptive filter as claimed in claim 2, further comprising an electric control unit operable to switch the magnet elements on and off in accordance with the contour to be formed.

15. The contour collimator or adaptive filter as claimed in claim 5, further comprising an electric control unit operable to switch the magnet elements on and off in accordance with the contour to be formed.

16. The contour collimator as claimed in claim 5, wherein a plurality of first and second layers are stacked, the plurality of first and second layers comprising the first layer and the at least one second layer.

17. A method for adjusting a contour in a ray path of an x-ray radiation using a contour collimator or an adaptive filter, the method comprising:

attracting a magnetic fluid and drawing the magnetic fluid from an area of an aperture; and forming the aperture as the contour by performing the attracting and drawing of the magnetic fields in a magnetic fluid that is impermeable to x-ray radiation.

18. The method as claimed in claim 17, wherein the magnetic fields are formed by switchable magnet elements.

19. The method as claimed in claim 17, wherein the magnetic fields are formed by electric currents.

20. The method as claimed in claim 18, wherein the magnetic fields are formed by electric currents.

* * * * *